United States Patent [19]

Güell

[11] 4,038,837

[45] Aug. 2, 1977

[54] NEEDLE SELECTION MECHANISM FOR KNITTING MACHINES

[75] Inventor: José María Dalmau Güell, Barcelona, Spain

[73] Assignee: Jumberca, S.A., Badalona, Spain

[21] Appl. No.: 707,011

[22] Filed: July 20, 1976

[30] Foreign Application Priority Data

July 24, 1975 Spain ..... 439702

[51] Int. Cl.[2] ..... D04B 15/78

[52] U.S. Cl. ..... 66/50 R

[58] Field of Search ..... 66/25, 50 R, 75 A, 154 A

[56] References Cited

U.S. PATENT DOCUMENTS

| | | | |
|---|---|---|---|
| 3,724,240 | 4/1973 | Flad | 66/50 R |
| 3,771,328 | 11/1973 | Schindele et al. | 66/50 R |
| 3,815,065 | 6/1974 | Hadam | 66/50 R X |
| 3,815,383 | 6/1974 | Hamma | 66/50 R |
| 3,855,819 | 12/1974 | Sawazaki | 66/50 R |
| 3,977,215 | 8/1976 | Orobitg | 66/50 R |
| 3,998,073 | 12/1976 | Luth | 66/50 R |

FOREIGN PATENT DOCUMENTS

| | | | |
|---|---|---|---|
| 2,537,118 | 3/1976 | Germany | 66/50 R |
| 362,787 | 8/1962 | Switzerland | 66/50 R |
| 483,511 | 2/1970 | Switzerland | 66/50 R |

*Primary Examiner*—Wm. Carter Reynolds
*Attorney, Agent, or Firm*—Staas & Halsey

[57] ABSTRACT

A needle selection mechanism for knitting machines wherein each selector member has a selection cam portion and a cocking member engaging portion which cocking member is constituted by a jack butt adapted to be selected by the selector member and in turn cock the selector member whereby the latter, when held by an electromagnetic misses the following selector jack having a butt at the same level, and when released thereby engages said following selector jack.

1 Claim, 18 Drawing Figures

NEEDLE SELECTION MECHANISM FOR KNITTING MACHINES

BACKGROUND OF THE INVENTION

1. Field of the Invention

The present invention relates to knitting machines and more particularly concerns an electromechanical needle selection mechanism for a knitting machine having a needle bed accomodating a plurality of needles and associated jacks.

In such knitting machines, each needle is controlled by a pushing member or jack for selectively lifting the needle to perform a knitting operation. The selector members are controlled by an electromagnet and have the task of placing the jack as required in an active position, from which position a cam lifts the jack, and the jack lifts the needle until a needle butt engages a cam which then lifts the needle to knit.

2. Description of the Prior Art

Some of the known mechanisms comprise two electromagnets and a permanent magnet attached to the selector member to return this to its rest position. With this arrangement, the selector member moves from one electromagnet to the other when the polarity their is inverted. These systems require a double number of electromagnets, with all the disadvantages that this entails.

A further known device uses two counteracting springs associated with each needle. One of these springs tends to hold the associated jack constantly in the selection position. At each feed, the second of said springs engages a fixed cam which cocks it with centrifugal movement to move it into the proximity of a fixed selection electromagnet. If the needle is not to be selected, this electromagnet repels said second spring which then engages a second cam which moves it in a contripetal direction. During this movement, this second spring presses the jack against the action of said first spring and thus separates it from a lifting cam. Otherwise, the electromagnet holds this second spring until it engages with the second cam, thereby preventing it from operating against the first spring, so that said jack is raised by the lifting cam.

With this device, the electromagnet works only on contact with the spring, which is an advantage over the constructions wherein the electromagnet must attract the spring itself.

However, this construction has from many other disadvantages. In the first place, it only allows selection at a single level per feed. Each needle has to be provided with two counteracting springs. Consequently, there is twice the number of springs as needles.

The second spring works under disadvantageous conditions as a result of having to overcome the bias of the first spring.

It is known that in this construction, the means allowing a reduction of the power of the electromagnet have concomitant disadvantages which are substantially as troublesome as those they allow to be overcome, so that the proposed solution does not provide any real technical progress.

Moreover, certain knitting machines use selection at several levels by disposing several stacked selectors for each feed, in order to increase the time available for performing selection, giving the possibility of accelerating the speed of relative movement of the selectors and the needle bed carrying the needles and, consequently, of increasing production.

Therefore, it is important that the selection devices used should be neither too large nor too expensive, while still providing complete operational reliability. The space occupied and the price of electromagnets are significant if one consider that a machine may have, for example, 48 feeds of 10 selectors each, making a total of 480 selectors. Thus, if each selector uses two electromagnets, as in one of the aforementioned solutions, 960 electromagnets would be needed.

Other devices provide for a sliding movement of the selector members for engagement with the corresponding electromagnet and they generally have the disadvantage of requiring very close tolerances in the limits of such movement. If the movement is insufficient, the selector member does not contact the electromagnet and this is not strong enough to attract the member, whereby the required selection does not take place. On the other hand, if the selector member contacts the electromagnet prior to its position of maximum recoil, friction and tension are produced causing operational deficiencies in the knitting machine's mechanical performance.

SUMMARY OF THE INVENTION

The object of the present invention is to remedy, at least partially, the abovementioned disadvantages, while increasing the operational reliability of the knitting machine.

According to the invention there is provided a needle selection mechanism for a knitting machine of the type having a frame; a needle bed rotatively movable relative to said frame; a plurality of needles mounted in said needle bed and capable of occupying two positions, a working position and a rest position; needle bed drive means; means for lifting said needles from one of said positions to the other and vice versa; selection means for said means comprising at least one selector member mounted to the machine frame and capable of occupying an active position wherein it engages the needle moving means an an inoperative position wherein it is dissociated from said means, resilient return means tending to urge said selector member constantly to a first of said positions, cocking members adapted for moving said selector member from said first position to the other of said positions, against the force of said resilient return means and electromagnet means for selectively retaining said selector member in said other of said positions in accordance with a programmed control.

According to the invention there is also provided a knitting machine characterised in that there are selector members at a plurality of levels and each selector member is provided, in the direction of rotation of the needle bed, with a first or selection cam shaped portion and a second or cocking member engaging portion and in that said needle lifting means comprises, for each needle, a transmission jack among other items, housed in a vertical slot of the needle bed and capable of longitudinal movement in said slot, said jack having a butt adapted to be engaged by said selection cam shaped portion and also adapted to act as cocking member against said selector member second portion, so that in a first stage said selector member first portion selectively causes longitudinal movement of said transmission jack in said needle bed slot, according to whether said selector member is in said first or said other of said positions and in a second stage said selector member, if it is in said first of said positions, is moved to said other of said positions by said butt acting as cocking member engaging said selector member second portion, said selector member selectively remaining in said other of said positions according to whether it is held or released by said electromagnet means, whereby said selector member selectively acts on the following transmission jack having a butt at the same level.

In a preferred embodiment of the invention, each selector member is so housed in the frame that it occupies a substantially radial position with respect to the needle bed, being restricted to radial movement and having at its front end an upper surface having the form of an upwardly inclined selector plane, said inclined plane having at the top portion thereof an angular slot, the apex of which is always located further removed from the axis of the needle bed than the end of the transmission jack butt and having a first side radial with respect to the needle bed and a second slide forming an acute angle with the said first side towards the needle bed so as to be closer thereto than the end of the transmission jack butt when the selector member is in the first of said positions, so that in a first stage the selector member front end inclined selector plane engages or misses the transmission jack butt according to whether said selector member is in the first or in the other of said positions, whereby said transmission jack is caused to rise longitudinally in said needle bed slot or is left unengaged, respectively, and in a second stage, if the selector member is in the first of said positions, when the butt reaches the height of the first side of said angular slot, said butt , acting as cocking member, engages the second side of said angular slot and pushes the selector member in a radial direction with respect to said needle bed towards said other position in which said selector member remains according to whether it is held or not retained by said electromagnetic means, whereby the selector member acts on or misses the following transmission jack having a butt at the same level.

According to the invention, there is provided an insert for attachment to the end of the selector member adjacent the electromagnetic holding means in such a way as to allow a slight variation of the relative positions radially between the insert and the selector member with respect to the needle bed there being also resilient means tending to urge the insert and the selector member towards longest possible length of the assembly, in said relative radial position.

According to the invention, said insert preferably is of straight section in U shape suitable for embracing the end of the selector member and being attached thereto with a transversal pin attached fixed to said insert and which goes through a bore of the selector member which has a larger diameter than said pin and wherein said spring means comprise at least on spring bearing against the bottom of the U-shaped cavity of the insert and urging against the selector member end edge, thereby tending to urge the insert and the selector member towards the longest possible length of the assembly in said relative radial position.

BRIEF DESCRIPTION OF THE DRAWING

To facilitate an understanding of the above ideas, reference is made hereinafter to the accompanying drawing which, in view of its explanatory nature must be considered as devoid of any limitation with respect to the scope of legal protection applied for. In the drawing.

DESCRIPTION OF THE PREFERRED EMBODIMENTS

Figure 1:
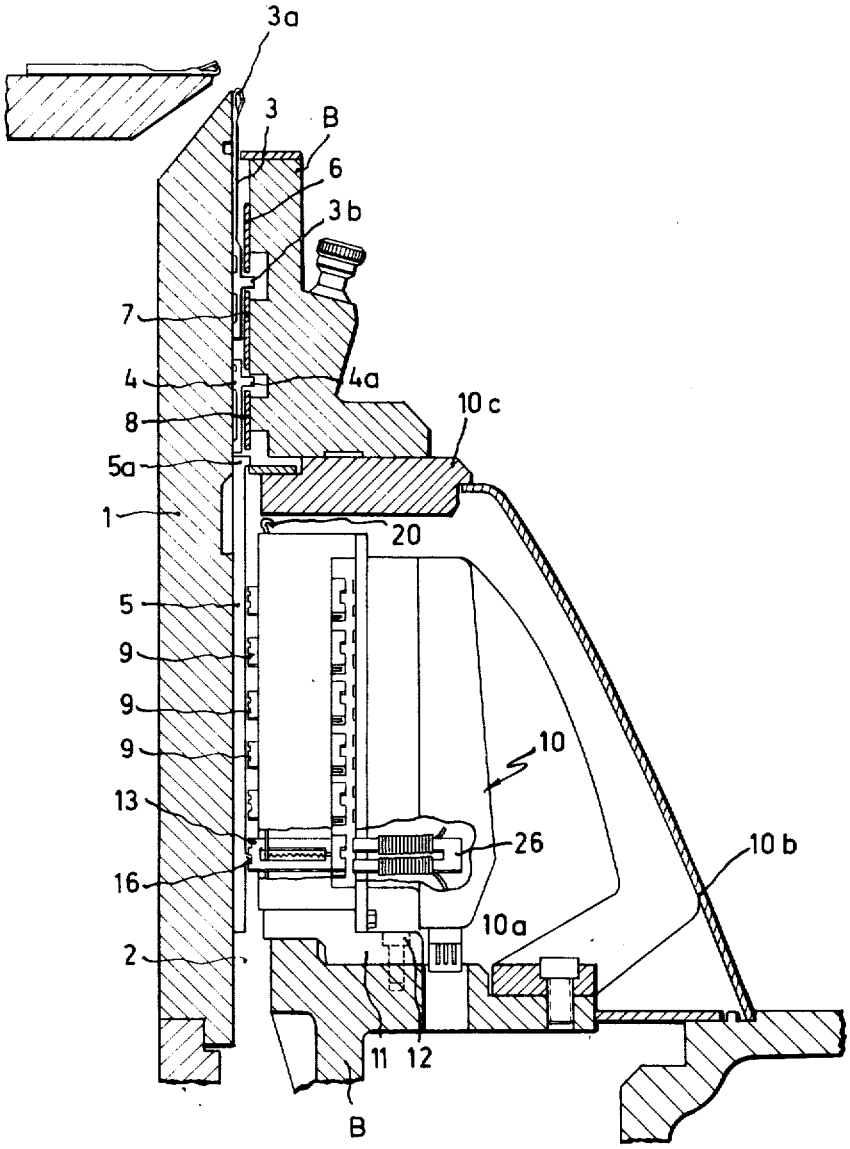
FIG. 1 is a partial diametrical cross sectional view along the line I—I of FIG. 1A, showing six selection levels.

The knitting machine exemplified in the drawing is a circular Jacquard-type knitting machine. Nevertheless, it is obvious that the principles of the selection mechanism more particularly described and shown are applicable to the selection of needles of flat knitting machines.

Figure 1A:
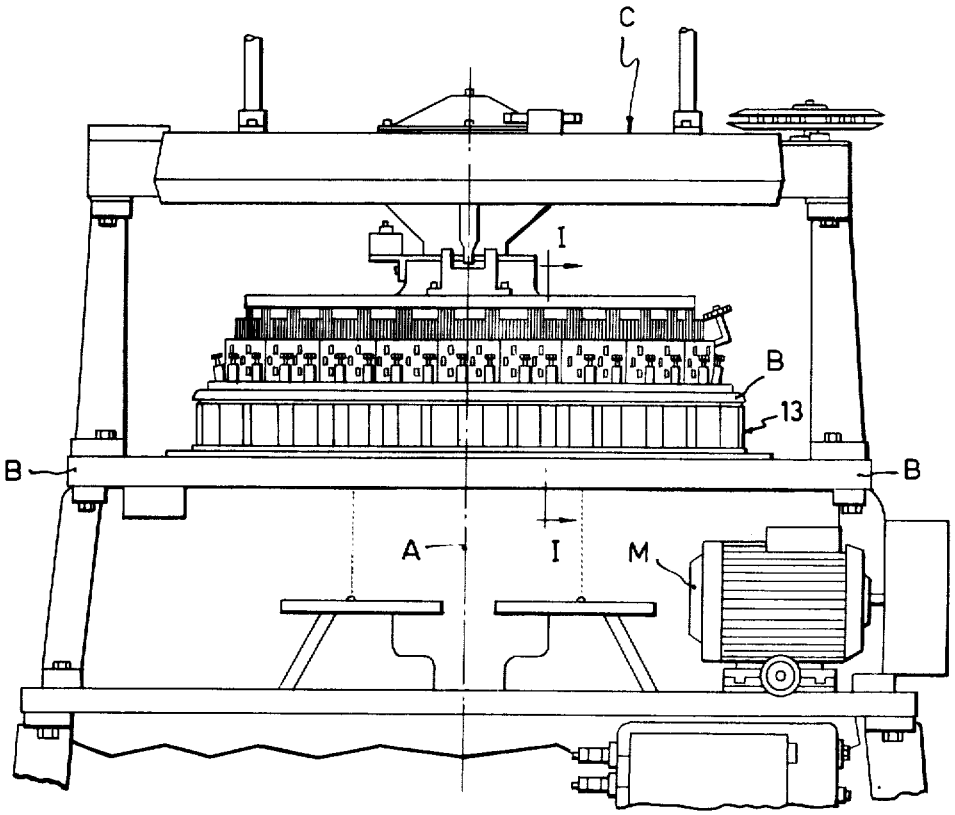
FIG. 1A is a general front elevation, partly in section, of a Jacquard type circular knitting machine, from which several members attached to the machine frame, such as legs, a feed, creel, and a take-up, beam, have been omitted.
Figure 2:
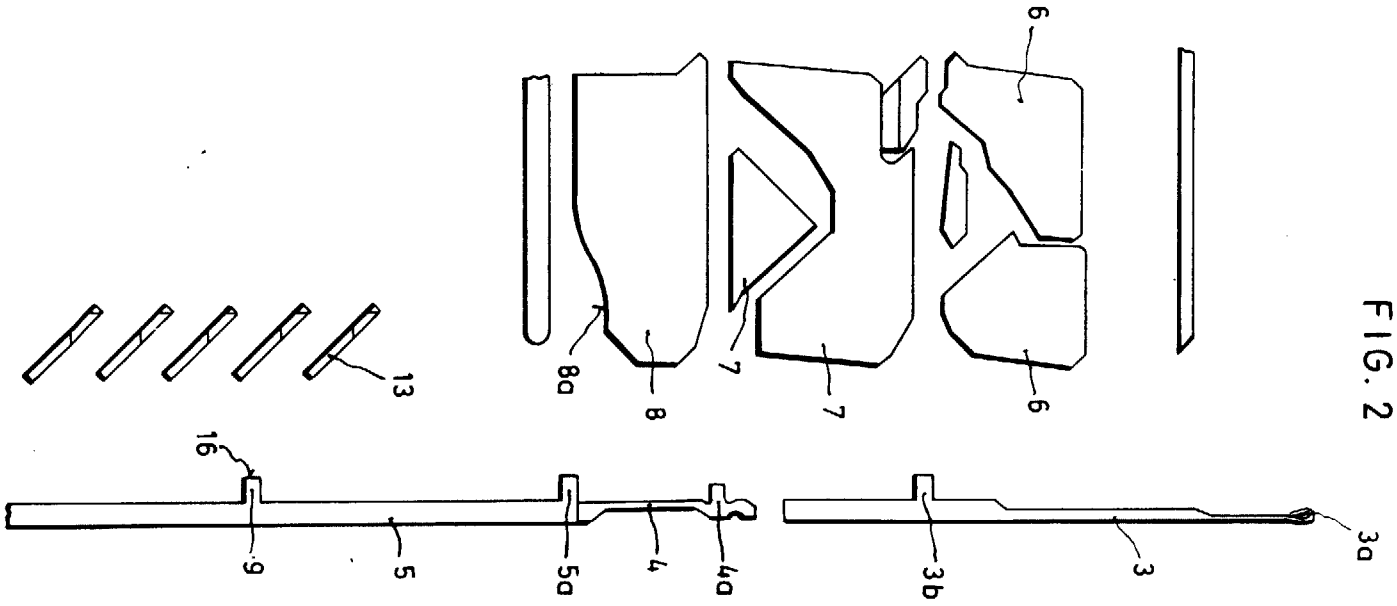
FIG. 2 is a diagrammatic view of a needle and means for moving same arranged with respect to the cams guiding such movement.

In FIG. 1A, in particular, there is to be seen a circular knitting machine C the needle bed of which (not shown) is mounted rotatably in a frame B and is caused to rotate around an axis A by a motor M.

A plurality of radial slots 2, one of which is to be seen in FIG. 1, are arranged in the outer surface of the needle bed 1. Each slot houses a needle 3, the upper end of which terminates in a latch **3*a*, a pusher member or intermediate jack 4 and a transmission jack 5. The needle 3, intermediate jack 4 and selection jack 5 all fit in the slot 2**, so as to be able to slide longitudinally with friction therein.

Needle 3 is provided with a butt **3*b* for engaging came 6 for lifting said needle 3. Intermediate jack 4 is provided with a butt 4*a* for engaging cams 7 which lift said jack 4**.

The transmission jack 5 is provided with a butt **5*a* for engaging an edge 8*a* of a cancellation cam 8**, as will be explained more fully hereinafter.

Transmission jack 5 is further provided with a butt 9. As is also to be seen in FIG. 1, the butts 9 of successive transmission jacks 5 are at different levels for a purpose to be explained more fully hereinafter.

Figure 3:
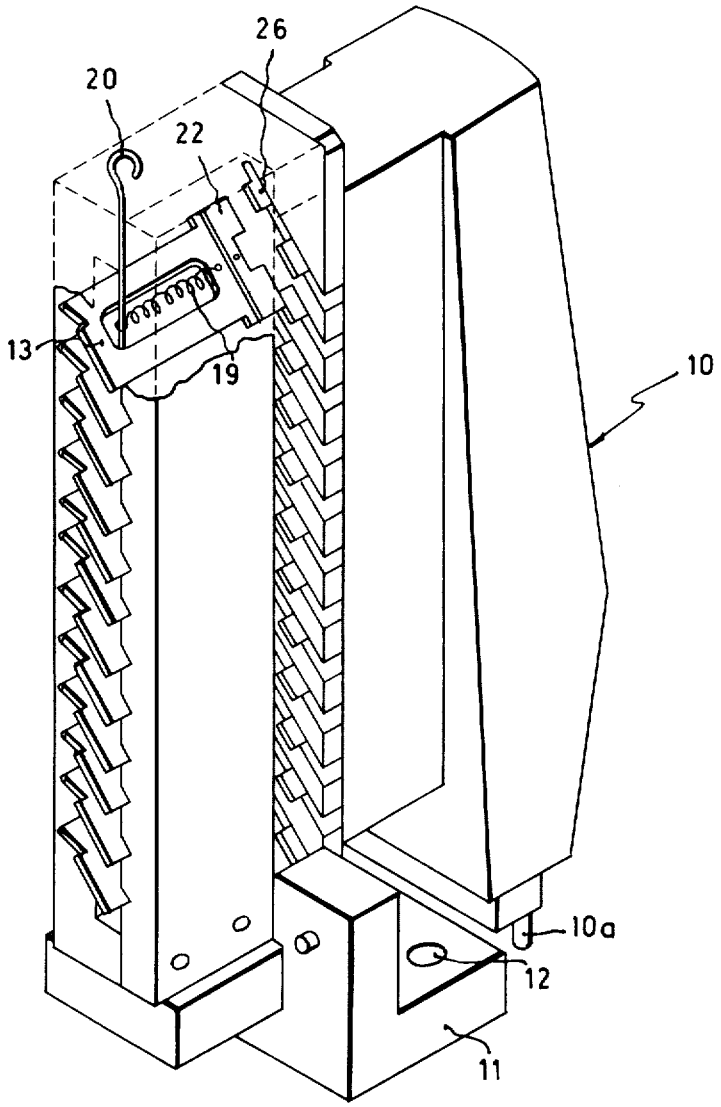
FIG. 3 is a perspective view of the selection device showing twelve selection levels.
Figure 4:
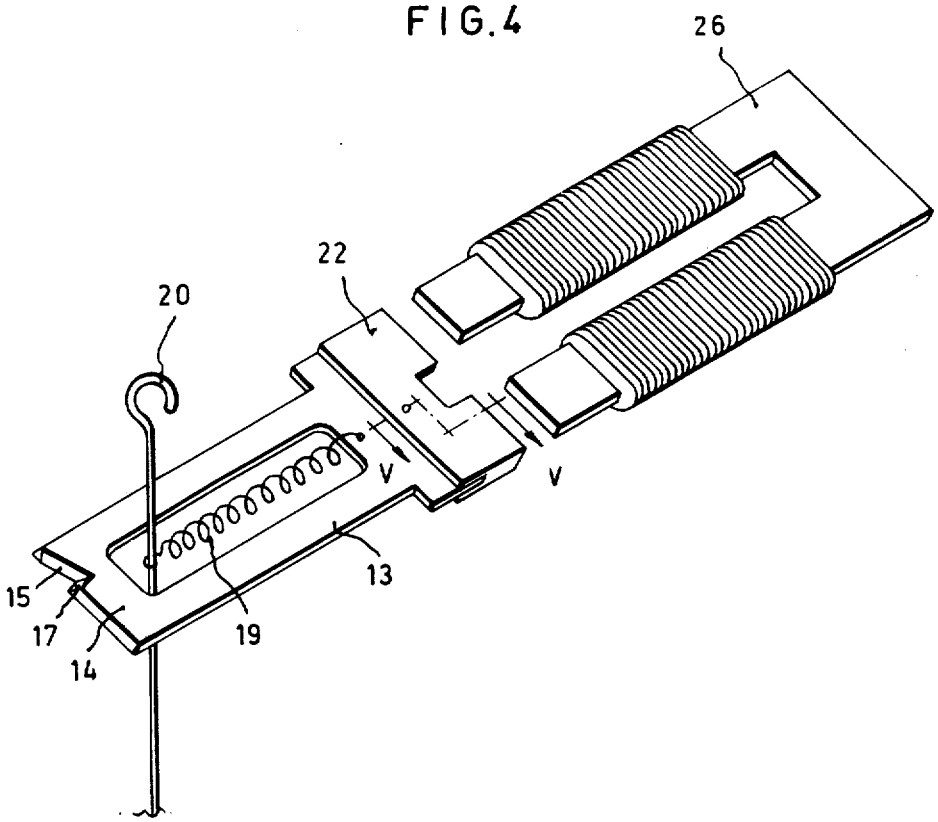
FIG. 4 is a perspective view of a selector member, separated from its housing in the frame, with the corresponding electromagnet.

A selection device 10 is mounted to frame B by a support 11 provided with means 12 for attachment thereto. Said selection device 10 comprises a plurality of selector members 13, six of which are exemplified in the FIG. 1 embodiment and twelve in the FIG. 3 embodiment. Such selector members are so housed in the device 10 that they occupy a generally radial position with respect to the needle bed and are capable of radial movement only. Said selection device 10 is provided with a connector 10*a* for connection to the programmed control, not shown. The device 10 is externally protected by a casing 10*b* bearing against the annular support 10*c*.

In the embodiments exemplified in the Figures, said selector members 13 are in strip form and are inclined upwardly in the direction of rotation of the needle bed. The front end 14 of said selector members 13 is a flat which, in view of the position of the selector members, is upwardly inclined, the upper end being interrupted by an angular notch 15, the apex of which is located always further removed from the axis of the needle bed than the edge 16 of butt 9 of transmission jack 5 (FIG. 1). Said angular slot 15 has a first side 17 arranged radially with respect to the needle bed and its second side 18 forms an acute angle with respect to said first side so that its end furthest away from the apex is closer to the needle bed than said edge 16 of butt 9 of transmission jack 5 when the selector member 13 is in its nearest possible position to the needle bed 1.

Selector member 13 is provided with a spring 19 which is attached to said member 13 and to a pin 20 attached to selection device 10 and tends to hold the selector member 13 in its closest possible position to the needle bed, its radially inward movement being limited by means not illustrated in the Figures. Its range of radially outward movement is sufficient for its front end to be farther removed from the needle bed 1 than the front edge 16 of butt 9.

Figure 5:
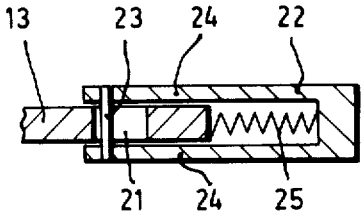
FIG. 5 is a partial sectional view of the selector member along the line V—V of FIG. 4.

The rear end of selector member 13 is provided with a bore 21 (FIG. 5) and is embraced by open-ended box a U-shaped member 22. Selector member 13 is attached to its corresponding U-shaped member 22 by a pin 23 fixed in the arms 24 of said U-shaped member 22 and crossing through the bore 21 of selector member 13, the diameter of said bore 21 being greater than that of the pin 13. Between the arms 24 of said box member 22 there are springs 25 having one end bearing against the bottom of the U and the other end bearing against the end edge of selector member 13, thereby tending to urge said U-shaped member 22 and selector member 13 into relative positions wherein the ensemble of the two takes on its maximum length.

This same selection device 10 is provided with electromagnets 26 which hold the corresponding selector member 13 on contacting the rear end of said U-shaped member, provided that such electromagnets 26 have been correspondingly energised in accordance with the programmed control.

Figure 12:
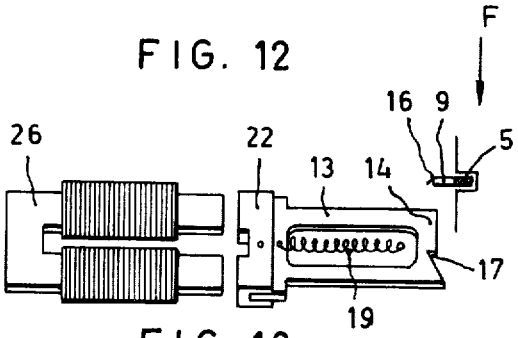
FIGS. 12, 13, 14, 15, 16 and 17 are diagrammatic views in the direction of the needle bed axis of a selector member and its electromagnet and the transmission jack having a butt situated at the level corresponding to the selector member, in relative positions shown respectively in FIGS. 6, 7, 8, 9, 10 and 11.
Figure 6:
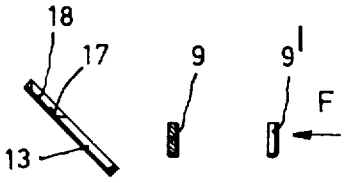
FIG. 6 is a diagrammatic front view of the front end of the selector member and of the butts of two consecutive transmission jacks having the butt at the same level, before the leading one engages the selector member.

As has already been said, the motor causes the needle bed 1 to rotate in the direction of the arrow F (FIGS. 6 and 12) and the transmission jack 5 moves in the same direction. If the selector member 13 corresponding to the level of butt 9 is not retained by the corresponding electromagnet 26, said selector member 13 is urged by the spring 19 to its closest possible position to the needle bed 1.

Figure 13:
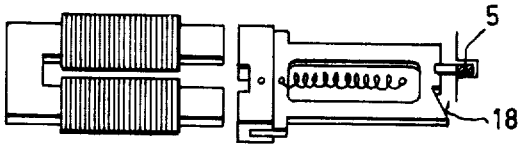
Figure 14:
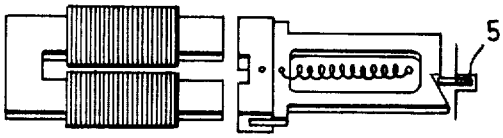
Figure 15:
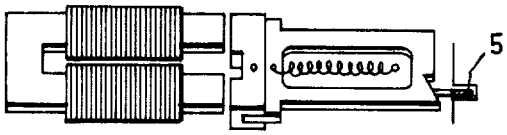
Figure 16:
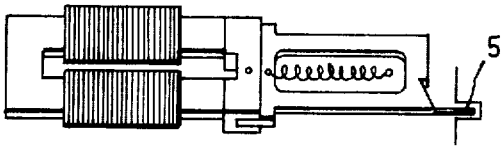
Figure 7:
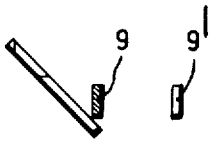
FIGS. 7, 8, 9, 10 and 11 are respective diagrammatic views of the same member in successive positions.
Figure 8:
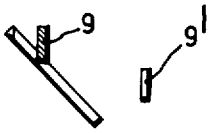
Figure 9:
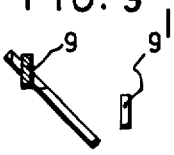
Figure 10:
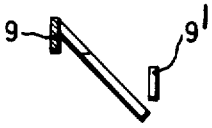

When butt 9 of transmission jack 5 engages the selector member 13, the butt 9 is driven along the upwardly inclined slope of the front end 14 and the jack 5 starts to rise in the slot 2 (FIGS. 7 and 13). When butt 9 reaches the level of the first side 17 of the angular slot 15 (FIGS. 8 and 14) said butt ceases rising and moves in the direction of the arrow F, whereby the edge 16 of butt 9 engages the second side 18 of the angular slot 15 (FIGS. 9 and 15) whereby the selector member 13 is moved radially outwards and backwards and approaches the electromagnet until it is cocked (FIGS. 10 and 16) when the rear end of U-shaped member 22 contacts the electromagnet 26.

If the following needle, having the butt 9′ of its transmission jack 5′ at the same level as the previous one, is to knit then the programmed control device sends no signal to the electromagnet 26 and if said needle is not to knit, then a signal is sent.

Figure 17:
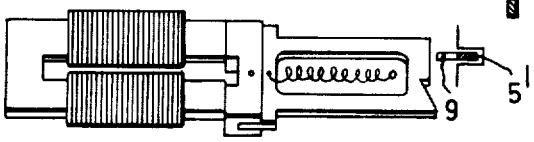
Figure 11:
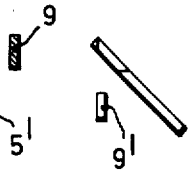

Let it be assumed that the electromagnet 26 has received a signal. In such case, the selector member 13 remains attracted to the electromagnet 26 and when the butt 9′ comes face to face with the selector member 13 (FIGS 11 and 17), said butt 9′ does not engage the sloped surface of the selector member since this is further removed from the needle bed and therefore, the needle corresponding to such jack is not selected.

If, on the other hand, no signal is sent to the electromagnet 26, then spring 19 urges the selector member 13 to recover its original position, that is, the position closest to the needle bed 1. In this position the selector member 13 can engage butt 9′ and select the corresponding needle, whereby the selector member is cocked again to determine selection or non-selection of the following needle having its selection jack butt at the same level as the previous ones.

This action of the selector member 13 on the butt 9 and, therefore on the selection jack 5, causes this jack to slide upwards in the slot 2, causing said jack 5 so to engage intermediate jack 4 that the butt 4*a* thereof is engaged by the cams 7, which move it and cause the lifting of needle 3 until the butt 3*b* thereof engages cams 6 and said needle 3 is lifted to knit.

When the edge 8*a* of cam 8 engages the upper edge of butt 5*a*, it acts as a cancellation cam and causes the jack 5 to slide downwards, if it has previously risen, and therefore places said jack 5 in a position to be engaged again by the following selector member as required.

The sliding movement of the selector member requires some very close tolerances, since if these are not respected the radially outward movement may not be sufficient to cause contact of the selector member with the electromagnet, and this does not have sufficient force to attract the latter or, otherwise, the selector member strip could contact the electromagnet before its maximum recoil position, thereby causing friction and tensions causing operational deficiencies in the machines mechanical performance.

Therefore, the U-shaped member 22 is urged by the springs 25 to the position of maximum separation with respect to the rear end of the selector member 13. When edge 16 of butt 9 engages the second slide 18 of the angular slot 15, the selector member 13 starts moving radially outwardly and presses against the spring 25, without overcoming it, and spring 15, acting against the bottom of the U-shaped cavity, moves the U-shaped member 22 to contact with the electromagnet 26. If the butt 9 were to continue urging the selector member 13 after contact had been made, the selector member 13 would continue in its radially outward movement, overcoming the strength of spring 25, without this movement causing movement of the U-shaped member 22, as a result of the play of the pin 23 in the larger diameter bore 21. Although reference has been made in the foregoing description to a single selection level, it should be understood that it is applicable to all the available selection levels of the knitting machine.

What I claim is:

1. A needle selection mechanism for a knitting machine of the type having a frame; a needle bed rotatably moveable relative to said frame; a plurality of needles mounted in said needle bed and capable of occupying at least two positions including a working position and a rest position; needle bed drive means; means for lifting said needles from one of said positions to the other of said positions and vice versa; a selection mechanism for said lifting means comprising at least one selector member mounted to the machine frame and positioned in a substantially radial position with respect to said needle bed and capable of radial movement between a first active position wherein it engages said needle lifting means and a second inactive position in which it is disassociated from said lifting means, resilient return means urging said selector member to said first position, cocking members adapted for moving said selector member from said first position to said second position against the force of said resilient return means, and electromagnet means for selectively retaining said selector member in said other of said positions in accordance with a programmed control, wherein there are selector members at a plurality of levels and each selector member is provided in the direction of rotation of said needle bed with a first selection cam shaped portion having at its front end and upper surface having the form of an upwardly inclined selector plane, said inclined plane having at the top portion thereof an angular slot, and a second cocking member engaging portion, and wherein said needle lifting means comprises for each needle a transmission jack housed in a vertical slot of said needle bed and capable of longitudinal movement in said slot, said jack having a butt adapted to be engaged by said selection cam shaped portion and also adapted to act as a said cocking member against said second engaging portion of said selector member such that in a first stage said first cam shaped portion of said selector member selectively causes longitudinal movement of said transmission jack in said slot of said needle bed according to whether said selector member is in said first or said second of said positions and in a second stage said selector member, if it is in said first of said positions, is moved to said second of said positions by said butt acting as a said cocking member engaging said second engaging portion of said selector member, said selector member selectively remaining in said second of said positions according to whether it is held or released by said electromagnet means, whereby said selector member selectively acts on the following transmission jack having a butt at the same level, and wherein the apex of said inclined plane of said selection cam shaped portion is always located further removed from the axis of said needle bed than the end of said transmission jack butt and has a first side positioned radially with respect to said needle bed and a second side of said second portion of said selector member forms an acute angle with said first side towards said needle bed so as to be closer thereto than the end of said transmission jack butt when said selector member is in the first stage of said positions so that in a first stage said selector member front end inclined selector plane engages or misses said transmission jack butt according to whether said selector member is in the first or in the second of said positions whereby said transmission jack is caused to rise longitudinally in said needle bed slot or is left unengaged, respectively, and in a second stage, if said selector member is in the first of said positions, when the butt reaches the height of the first side of said angular slot, and wherein said butt, acting as a said cocking member, engages the second side of said angular slot and pushes said selector member in a radial direction with respect to said needle bed towards said other position in which said selector member remains according to whether it is held or not retained by said electromagnetic means, whereby said selector member acts or misses the following transmission jack having a butt at the same level.

* * * * *